US005611579A

United States Patent [19]

Kreitenberg

[11] Patent Number: 5,611,579

[45] Date of Patent: Mar. 18, 1997

[54] EARTHQUAKE ACTIVATED SAFETY LATCH

[76] Inventor: Arthur Kreitenberg, 12216 Shetland La., Los Angeles, Calif. 90049

[21] Appl. No.: 272,801

[22] Filed: Jul. 11, 1994

[51] Int. Cl.[6] ..... E05C 19/10

[52] U.S. Cl. ..... 292/130; 292/230; 292/DIG. 65

[58] Field of Search ..... 292/130, 230, 292/231, 251.5, DIG. 22, DIG. 65

[56] References Cited

U.S. PATENT DOCUMENTS

| | | | |
|---|---|---|---|
| 590,818 | 10/1897 | Blackburn . | |
| 711,696 | 10/1902 | Cook | 292/130 |
| 882,296 | 3/1908 | Carroll | 292/130 |
| 1,155,953 | 10/1915 | Morrow | 292/130 |
| 3,397,001 | 8/1968 | Friedman | 292/87 |
| 3,878,858 | 4/1975 | Yamada | 137/38 |
| 4,007,643 | 2/1977 | Matsushita | 74/2 |
| 4,185,507 | 1/1980 | Domyan | 74/2 |
| 4,505,526 | 3/1985 | Leck | 312/333 |
| 4,513,629 | 4/1985 | Keller | 74/2 |
| 4,714,282 | 12/1987 | Henderson | 292/1 |
| 4,739,896 | 4/1988 | Moss | 292/130 X |
| 4,909,571 | 3/1990 | Vidwans | 297/379 |
| 4,988,134 | 1/1991 | Vidwans | 292/198 |
| 5,035,451 | 7/1991 | Brady | 292/96 |
| 5,152,562 | 10/1992 | Stevenson | 292/252 |
| 5,312,143 | 5/1994 | Buckner | 292/230 |
| 5,370,440 | 12/1994 | Rogala | 297/216 |
| 5,388,901 | 2/1995 | Asano | 312/319.1 |
| 5,404,257 | 4/1995 | Alt | 360/97.01 |

*Primary Examiner*—Rodney M. Lindsey
*Assistant Examiner*—Monica E. Millner
*Attorney, Agent, or Firm*—Merchant, Gould, Smith, Edell, Welter & Schmidt

[57] ABSTRACT

A cabinet mounted latch is activated by the movements of an earthquake from a ready position. The latch then engages a door mounted hook to prevent door opening, preventing loss of contents and personal injury. The device may be manually activated or inactivated to provide on demand childproofing or unobstructed door use.

24 Claims, 8 Drawing Sheets

EARTHQUAKE ACTIVATED SAFETY LATCH

BACKGROUND

This invention relates to cabinet door safety latches, specifically to devices preventing the unwanted opening of cabinet doors.

During an earthquake, rapid motions cause unsecured contents within cabinets to shift. Cabinet doors may spontaneously open, causing loss of contents. Personal injury may result from projectiles or broken glass, crystal and china. Throughout this application, the technology described may be equally applied to drawer faces as well as cabinet, closet and cupboard doors.

Several devices are currently commercially available to prevent unwanted cabinet door opening. Several devices available may be considered as preventing doors from spontaneously "wandering" open. Common examples include a magnet mounted to the cabinet with a metal plate mounted to the door in a corresponding position. Another example is a semicircular metal latch on the door that engages a plastic circular roller that holds the door shut in place. Minimal manual effort is required to overcome the holding force and open the door. These devices are not considered childproof or effectively earthquake safe. A wide variety of this type of mechanism has been available for decades.

Another type of device involves a latch attached to the cabinet handle which requires the handle to be pulled, twisted or pushed to open the door, much like a standard car door. These devices adequately prevent unwanted cabinet door opening, but are generally not considered childproof. They are relatively expensive and may require special tools and skills for proper installation.

Commercially available childproof latches are usually door mounted simple hooks which engage the edge of the cabinet face or a corresponding cabinet mounted fixed latch. An elastic or spring loaded device allows an adult finger to move the hook clear of the cabinet edge to allow the door to open. These devices are often cumbersome and inconvenient to use and usually require both hands to open the cabinet door.

Earthquake safety authorities have recommended the use of childproof latches as a means of preventing unwanted cabinet door opening during an earthquake. A considerable deterrent to the use of childproof latches for this purpose is the inconvenience of their use on a daily basis simply in anticipation of an earthquake that may never come.

Accordingly, objects and advantages of my invention include provision of a latch with two easily changed operational modes, one as a standard childhood safety latch and the other as a self activated earthquake ready mode.

SUMMARY

According to the invention, a door latch device is described comprising a housing, a movable latch mounted with said housing, and a means for limiting latch motion, the means being adjustable such that the amount of permissible latch movement is variable.

Also according to the invention, a door latch device is described for operation with two foundation elements which are movable relative to each other to cooperate between an adjacent position relative to each other and a separated position relative to each other comprising: a housing for mounting on one of the elements, a hook for mounting on the other element, a latch perfectly mounted with the housing between a first position removed from inter engagement with a mating hook and a second position permitting engagement with the hook; and means for variably limiting the movement of the latch when in the removed position such that the extent of the removed position is selectable.

The device will be appealing to at least three sets of consumers:

(a) Individuals located in earthquake prone areas would benefit from a device which automatically and immediately "locks" cabinet doors in response to the earth shaking. This well prevent loss of contents and personal injury. The sensitivity of the device is easily adjusted to prevent locking with minor tremblors. Normal and unobstructed use of cabinets is provided in intervals between quakes.

(b) Families with small children require restricted use of at least some cabinets holding potentially dangerous contents such as knives and cleaning agents. A significant advantage of the current invention is that when the children are older, the device is easily converted to the earthquake ready mode and left permanently in place.

(c) Grandparents, relatives and friends who may have small children in their homes intermittently can childproof their cabinets in a matter of seconds with the described device. When the children leave, unobstructed cabinet use may be resumed in a matter of seconds in the earthquake ready mode.

The device is easily and quickly installed in virtually any cabinet configuration. Once installed, it is left permanently in place for the life of the cabinet with virtually no maintenance or thought required. The cost to the consumer is low, well below the cost of replacing a single broken plate or glass.

DRAWINGS

Figure 6:
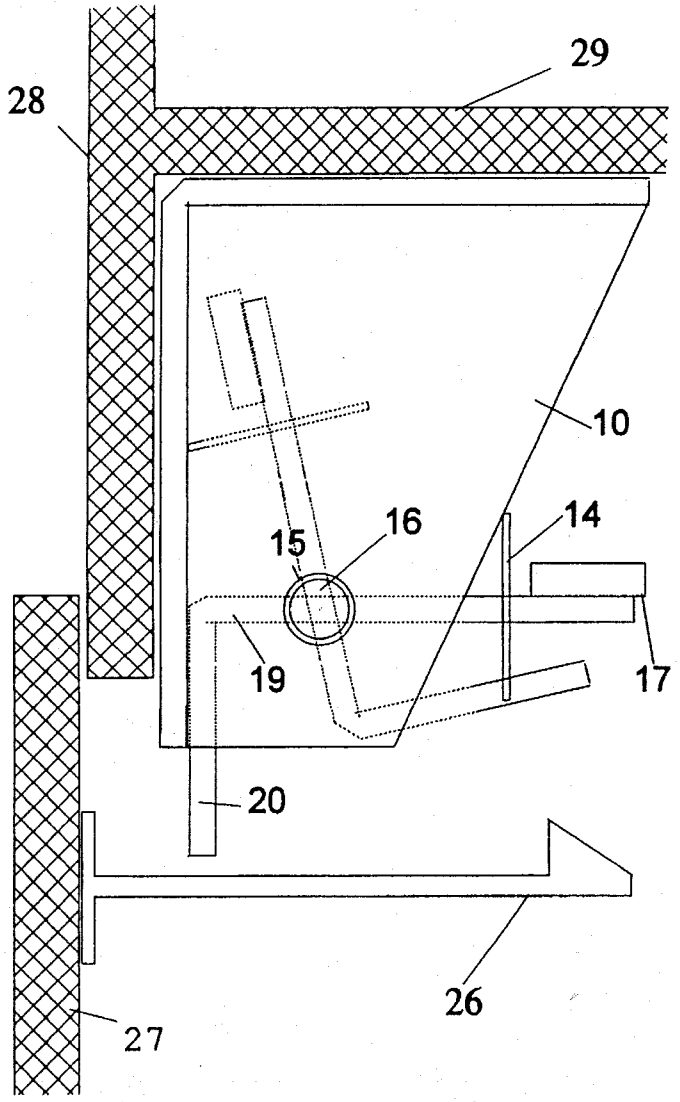
Figures 7A, 7B:
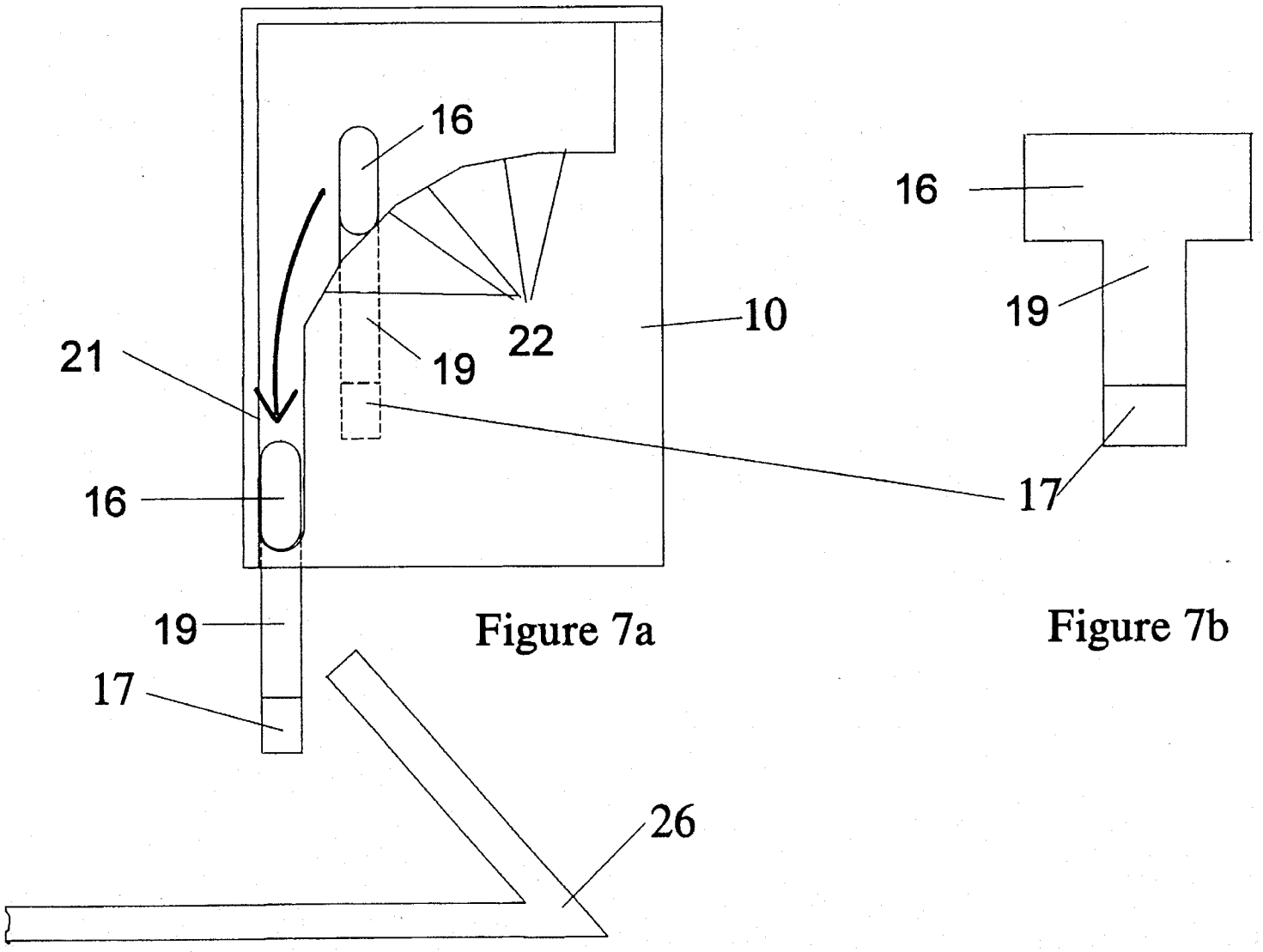

FIGS. 6 and 7*a* and 7B show additional alternative embodiments of Safety Latches.

Figure 8:
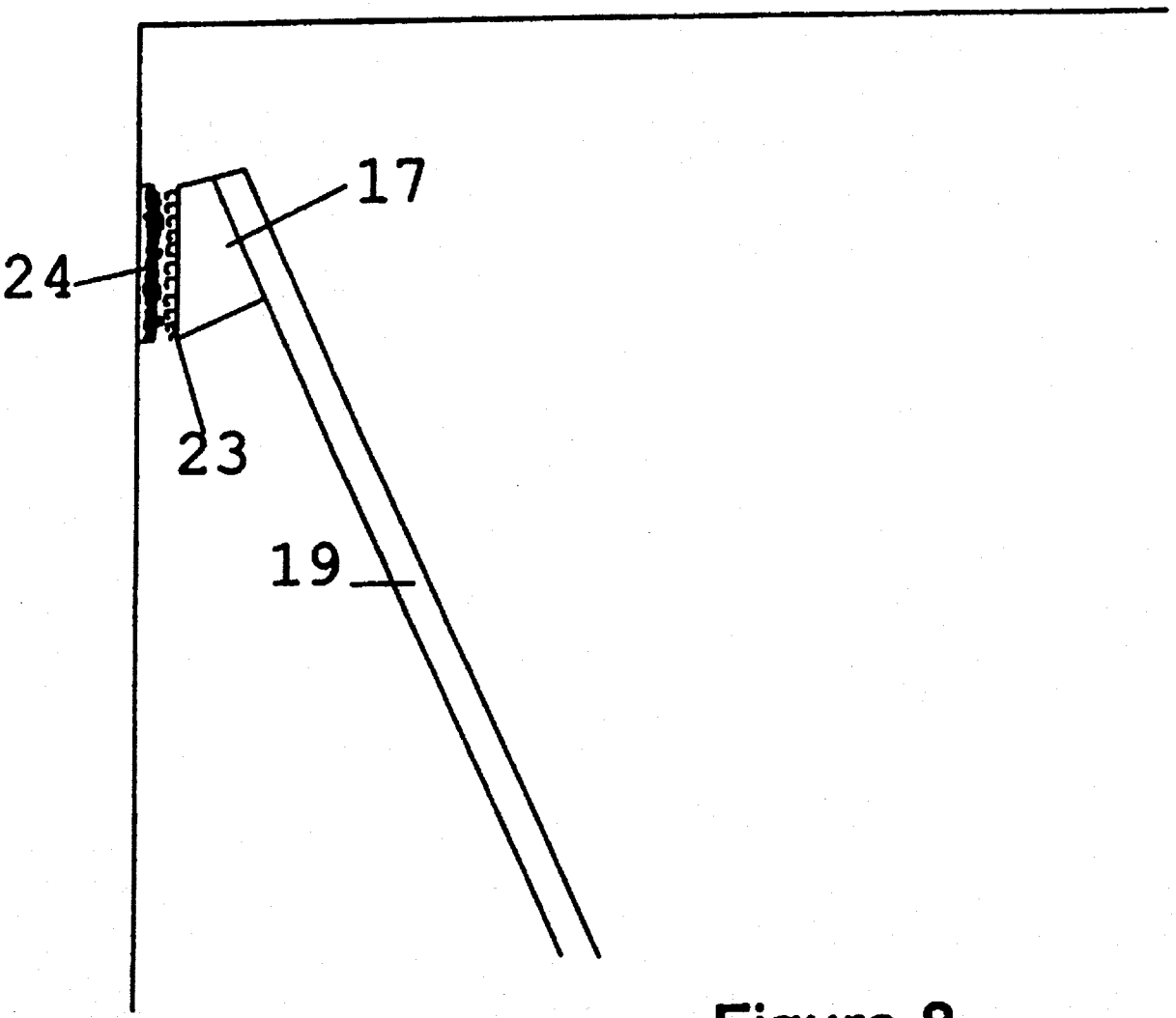

FIG. 8 shows an alternative embodiment of a coupling means utilizing a hook and loop fastener such as Velcro.

DESCRIPTION

Figure 1:
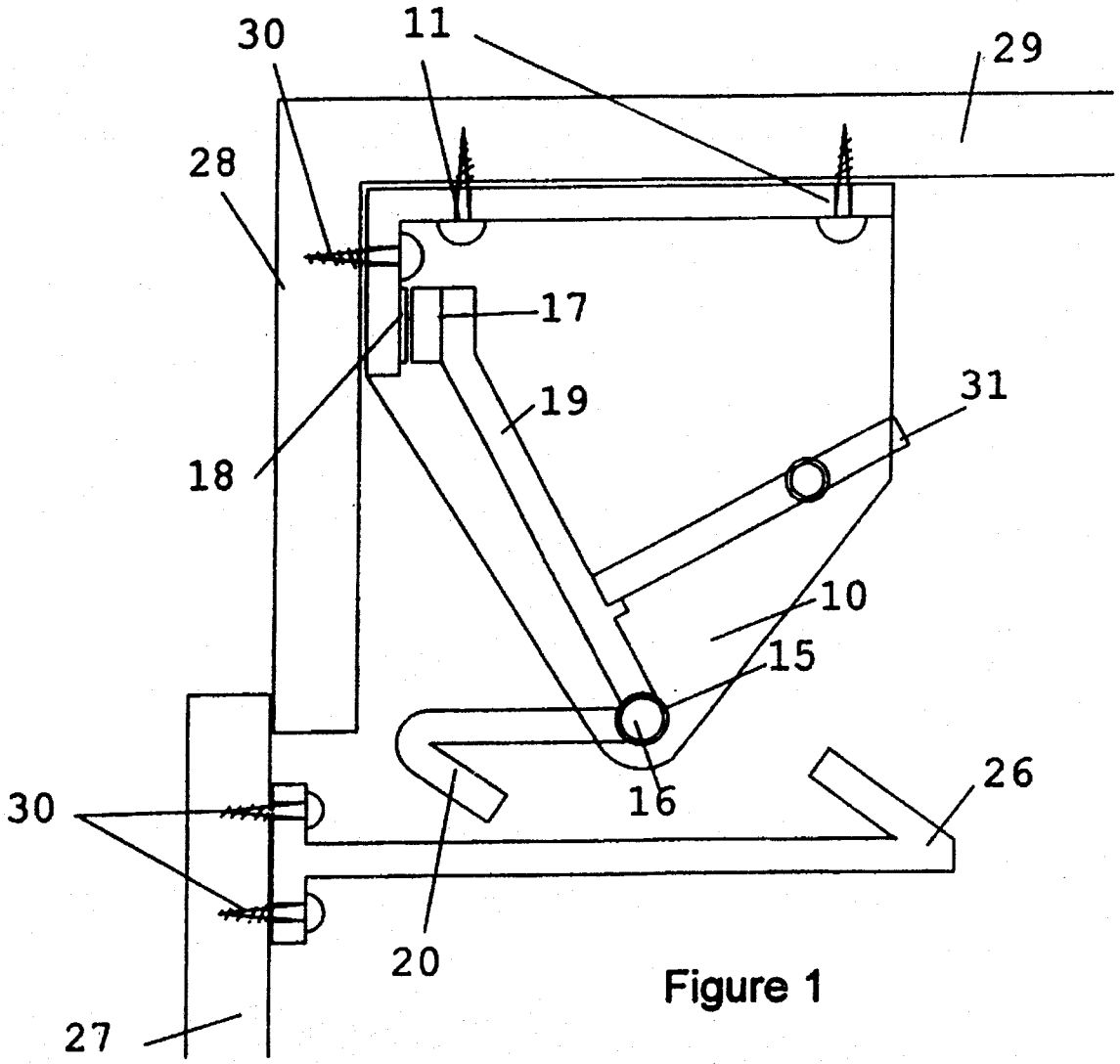
FIG. 1 shows a side view Of a Safety Latch in the childproof position.
Figure 2:
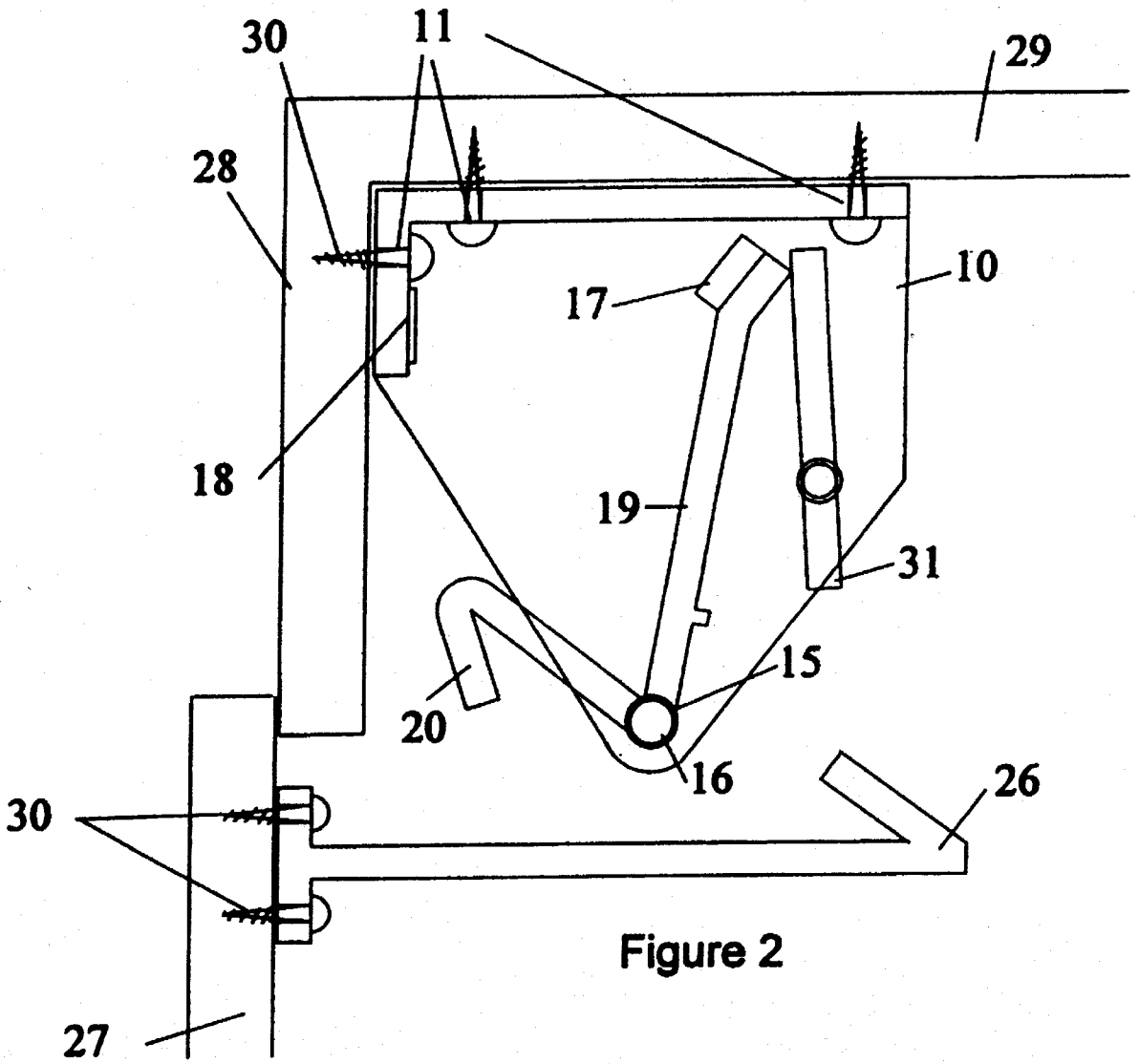
FIG. 2 shows a side view of a Safety Latch in the earthquake ready position.
Figure 3:
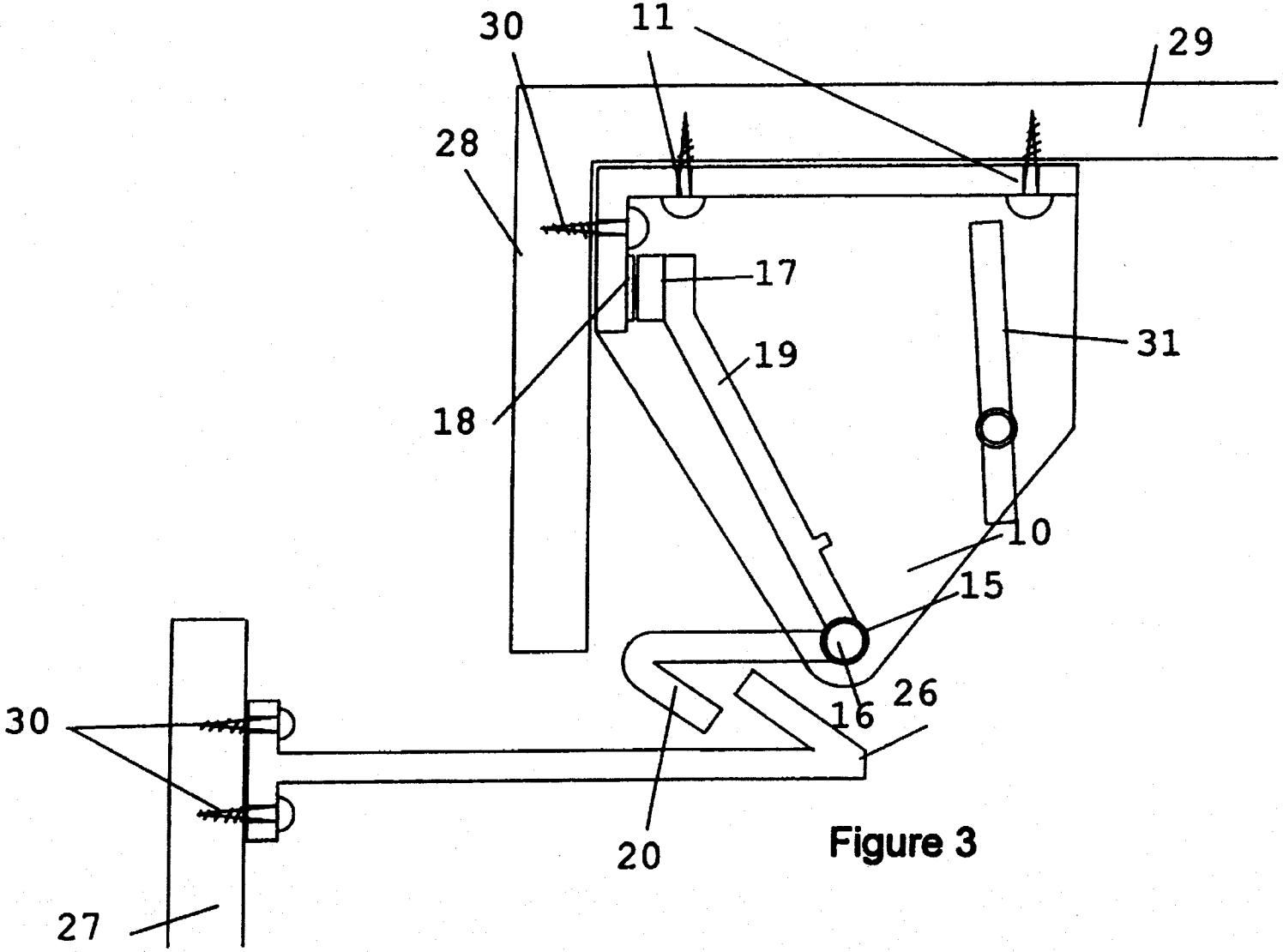
FIG. 3 shows a side view of a Safety Latch immediately after an earthquake begins.

A typical embodiment of the device is depicted in FIG. 1 in a position permitting engagement of a latch projection (20) with a mating hook (26) in a childproof mode. FIG. 2 depicts the device in a ready position removed from inter engagement with hook (26). FIG. 3 depicts the device immediately after an earthquake has begun with latch projection (20) having fallen back into position permitting engagement of mating hook (26).

Hook like device (26) is affixed to a cabinet door (27). Such hooks, some with spring loaded mechanisms are currently commercially available and intended to latch directly to a cabinet face (28) edge. Hook (26) is mounted in a location easily accessible to the user's finger and such that it will engage latch projection (20) when activated. The hook may be mounted upright vertically as shown or may be mounted horizontally, depending on cabinet and door configuration.

A box like housing (10) is shown oriented with the front toward the reader's left. Multiple mounting holes (11) accommodate screws (30) affixing the housing to cabinet face (28), side or shelf(or top) (29), depending on the configuration and application. Additional holes (11) may be placed in housing (10) sides for side mounting in cabinet. Alternatively, an adhesive may be used for mounting the housing (10) to the cabinet.

A lever (31) is snugly and rotatably mounted in housing (10) so that only purposeful manual pressure allows it to rotate.

Post holes (15) in the sides of housing (10) accommodate two posts (16) of a latch (19) allowing free pivoting and rotation of latch (19) within housing (10).

Mounted on the inner wall of housing (10) front is a ferrous counterweight contact (18) positioned so as to abut a magnetized counterweight (17) when latch (19) is in an activated position.

Latch (19) has a projection (20) at its lower end to engage hook (26). A magnetized counterweight (17) is attached to the upper end of latch (19).

OPERATION

A. Installation

Hook (26) is mounted to cabinet door (27) so that it is accessible to user's finger with cabinet door (27) slightly open. It should engage latch projection (20) in the activated position. The hook (26) may be mounted to the door (27) so that the hook portion points up or to either side, depending on the configuration and application.

Housing (10) may be mounted to the cabinet by screws or an adhesive. Depending on the cabinet configuration and the application, the front, top or side of the housing (10) may be utilized for mounting. Screws (30) are placed through mounting holes (11) in the housing (10) and into cabinet rear face (28), shelf (or top) (29), or side. Housing (10) is mounted so that in the activated position, latch projection (20) engages door mounted hook (26). In the ready position, hook (26) swings free of latch projection (20).

B. Childproof Mode

In a home where small children live, lever (31) is rotated down as in FIG. 1. This locks latch (19) in a forward position. Projection (20) is in a position such that inter engagement with hook (26) occurs and provides constant locking of door (27). With door (27) slightly open, the elasticity intrinsic to hook (26) allows the adult finger to move hook (26) free of latch projection (20) and open cabinet door (27) completely. When door (27) is swung closed, the intrinsic elasticity and configuration of hook (26) allows automatic relatching and locking of door (27).

C. Earthquake Ready Mode

When no small children are present and unobstructed door (27) function is desired, lever (31) is rotated back to a desired level of sensitivity. Latch (19) is then rotated back to abut against lever (31). Hook (26) may now freely pass by latch projection (20), allowing normal one handed unobstructed cabinet door (27) use.

The sensitivity of activation is varied by manually rotating lever (31) forward or backward. Too sensitive a setting may cause activation with only minor tremblors or slamming of cabinet door (27). An inadequately sensitive setting may not allow activation even during a major quake. It is recommended that a setting be initially selected just lower than that which allows activation with door (27) slamming. The sensitivity may then be decreased by further rotating lever (31) back if minor tremors cause unwanted activation.

No specific maintenance is required but it is recommended that latch (19), posts (16) and post holes (15) be periodically inspected to be free of dirt or debris that may interfere with free and smooth rotation.

D. During an Earthquake

Should an earthquake occur, the shaking, particularly acceleration perpendicular to the cabinet door, causes the counterweight (17) to move forward shifting the latch (19) to an activated position. As door (27) swings slightly open, hook (26) engages latch projection (20), arresting further opening. This prevents the shifting cabinet contents from falling or becoming dangerous projectiles.

Once latch (19) has fallen into an activated position, counterweight (17) abuts and magnetically adheres to counterweight contact (18) to prevent de-activation with continued quake activity.

Following the earthquake, door (27) is slightly opened to allow a finger to move hook (26) free of latch projection (20). Care must be taken to protect the user from contents that have become "perched" and fall when door (27) is fully opened. Counterweight (17) is manually uncoupled from contact (18) and latch (20) is rotated back to a ready position.

E. "Grandparent Use"

In those households where small children are only intermittently present, the device is usually kept in the earthquake ready mode. When children are present, door (27) is opened and latch (19) manually rotated forward to the activated position. Counterweight (17) is coupled to contact (18) so that latch (19) is maintained in an activated position. When the children leave, counterweight (17) is uncoupled from contact (18) and latch (19) is manually rotated back to the earthquake ready mode. For additional safety, lever (31) may be rotated forward as in FIG. 1 to "lock in" the safety mode.

CONCLUSION, RAMIFICATIONS AND SCOPE OF INVENTION

Thus the reader will see that the self activated safety latch provides a means of preventing unwanted cabinet door opening during an earthquake or when children are present but allows unobstructed use at all other times.

While my above description contains many specifications, these should not be construed as limitations on the scope of the invention, but rather as an exemplification of one preferred embodiment thereof. Many other variations are possible.

Common to various embodiments is the concept of "unstable equilibrium". The latch remains in equilibrium or at rest until such time that it is acted on by a force, either the acceleration of an earthquake or an adult finger moving the latch. Once the equilibrium is disrupted, gravitational force causes the latch to drop into place.

For example, FIGS. 4, 5, 6 and 7 depict alternate latch configurations. Common to these designs is a ready position wherein the latch is removed from door mounted hook (26) inter engagement and an activated position where the latch engages the hook.

Figure 4:
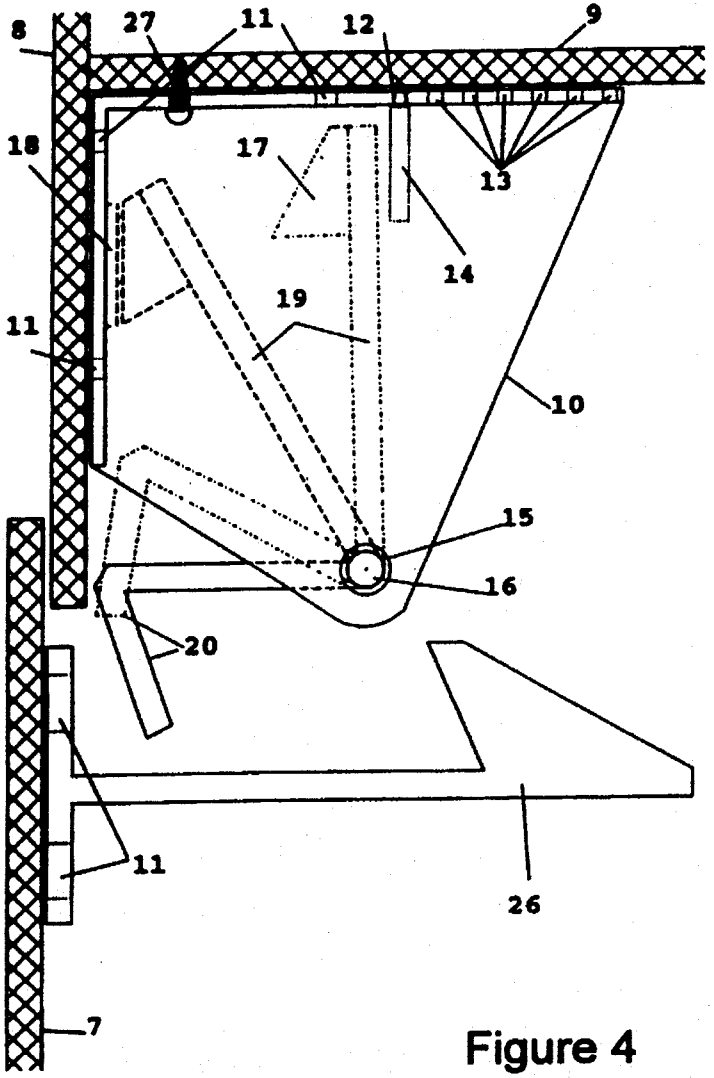
FIG. 4 shows a side view of an alternative embodiment of a Safety Latch.
Figure 5:
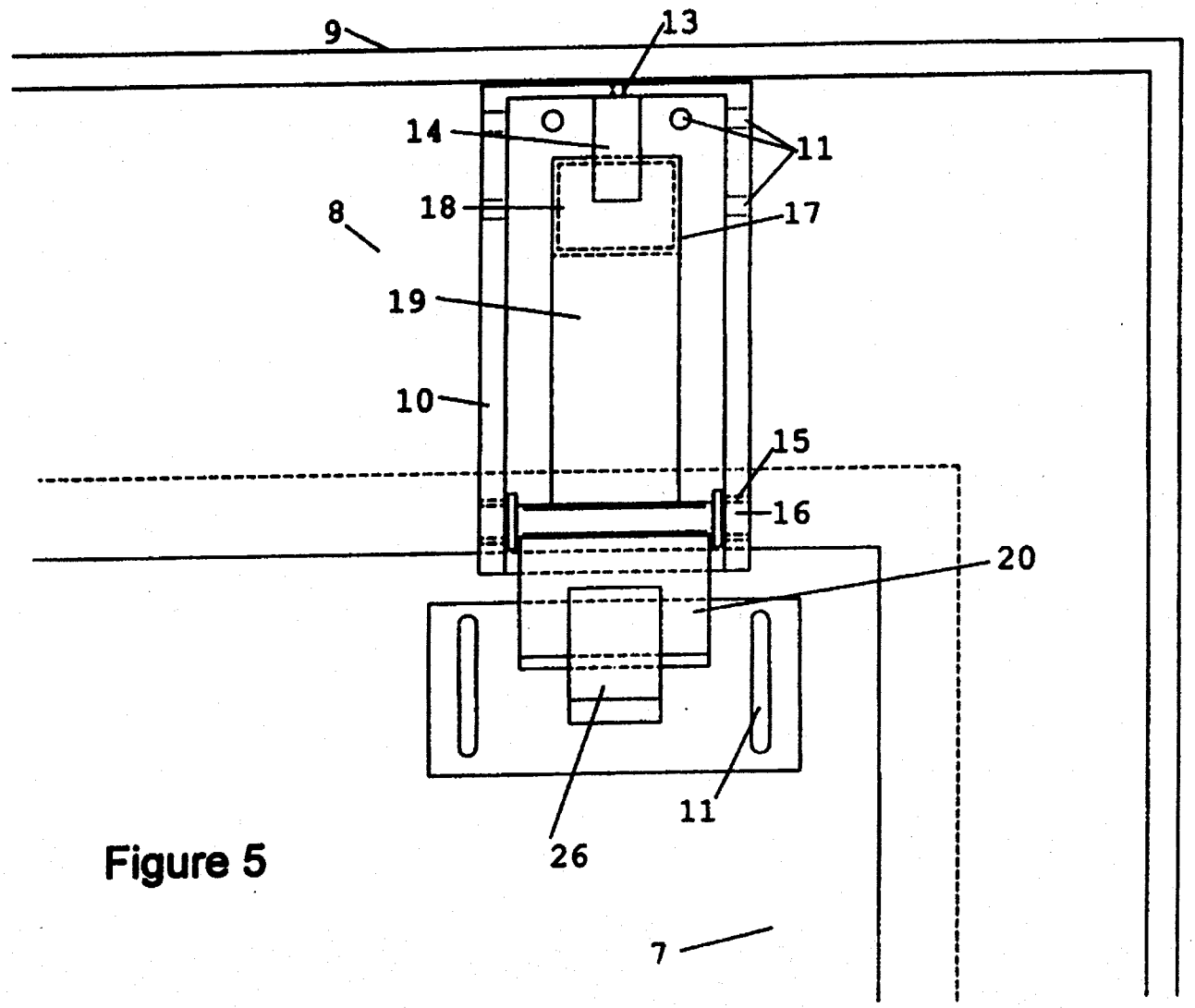
FIG. 5 shows a rear view of the Safety Latch, corresponding to an activated position of FIG. 4.

FIG. 4 shows a side view and FIG. 5 shows a rear view of an embodiment wherein multiple set peg holes (13) in the top of housing (10) accommodate a set peg (14). A forward set peg hole (12) is located so that the set peg (14) may prevent latch (19) from returning to a ready position when small children are present.

The sensitivity of activation is varied by choosing an appropriate set peg hole (13) for set peg (14) insertion. Sensitivity is decreased by selection of holes (13) closer to the rear of housing (10).

FIG. 6 shows an alternate embodiment in which the latch rotates in a direction opposite that of FIG. 1 in case of earthquake. Also shown is a peg (14), mounted snugly into latch (19). By pushing or pulling peg (14),the sensitivity may be adjusted, as this varies the position of the counterweight relative to pivot point at posts (16) in the ready mode.

FIG. 7 shows a non pivoting sliding type device. In an earthquake, latch (19) slides from a ready position above down a track and slot (21) in the housing. Ledges (22) of varying slope magnitude are provided to select the sensitivity of the device. The latch (19) may also be manually placed into slot (21) to provide a child safety mode of operation.

FIG. 8 shows an alternate means of coupling the counterweight (17) with counterweight contact using a hook (23) and loop (24) fastener such as Velcro.

As these alternate embodiments illustrate, a variety of methods may be used to adjust the sensitivity including varying the degree of friction of the hinge of latch (19).

Alternate uses of such a device could include storage facility doors in mobile vehicles such as campers, boats and aircraft. Sensitivity would be decreased in these applications so that activation occurred at only the most severe perturbations.

Accordingly, the scope of the invention should be determined not by the embodiments illustrated, but by the appended claims and their legal equivalents.

I claim:

1. A door latching device comprising (a) a housing, (b) an engaging element, (c) a movable latch pivotally mounted with said housing about a pivot location, and (d) means for limiting latch motion over a range, the means being adjustable to multiple different positions over the range such that the amount of permissible latch movement is variable to be a selected amount in the range, such that there is a different amount of travel possible by the latch between a first position of non-engagement and a position of engagement with the engaging element, the first position of non-engagement being different for different positions of the limiting means and wherein the means for limiting the latch in the removed position engages the latch to normally remain retracted from the engaging element under the principle of unstable equilibrium wherein the center of gravity of the latch in an unlatched position is located in a position relatively closely vertically aligned with the pivot location.

2. The door latching device as claimed in claim 1 wherein the engaging element includes a hook for engaging said latch and means for affixing said hook to a surface.

3. The door latching device as claimed in claim 2 wherein said hook includes elastic means for permitting manual deflection of the hook away from said latch.

4. The door latching device as claimed in claim 1 further including means coupling said latch at a position wherein the latch movement is limited by the coupling means.

5. The door latching device as claimed in claim 4 wherein said coupling means is magnetic.

6. The door latching device as claimed in claim 4 wherein said coupling means is hook and loop fastener.

7. The door latching device as claimed in claim 1 further including means for attaching said housing to a surface.

8. The door latching device as claimed in claim 1 wherein said motion limiting means is arranged so as to allow said latch to move in response to a predetermined acceleration magnitude.

9. The door latching device as claimed in claim 8 wherein the motion limiting means includes a removable peg means and a plurality of holes in said housing for accommodating the peg in a selected hole.

10. The door latching device as claimed in claim 1 wherein said latch is joined to said housing by a hinge means.

11. The door latching device as claimed in claim 1 wherein said latch is joined to said housing by a sliding translation means.

12. A door latch device for operation with two foundation elements which are movable relative to each other to cooperate between an adjacent position relative to each other and a separated position relative to each other comprising:

a. a housing for mounting on one of said two foundation elements, b. a hook for mounting on another of said two foundation elements, c. a latch mounted pivotally with the housing about a pivot location for movement between a first position removed from inter engagement with a mating hook and a second position permitting engagement with the hook; and d. means for variably limiting the movement of the latch over a range, the means being adjustable to multiple different positions over the range such that the amount of permissible latch movement is variable to be a selected amount in the range, such that there is a different amount of travel possible by the latch between a first position of non-engagement and a position of engagement with the hook, the first position of non-engagement being different for different positions of the limiting means and wherein the means for limiting the latch in the removed position engages the latch to normally remain retracted from the hook under the principle of unstable equilibrium wherein the center of gravity of the latch in an unlatched position is located in a position relatively closely vertically aligned with the pivot location.

13. A device as claimed in claim 12 wherein a pivot is located in a position removed from the elements.

14. A device as claimed in claim 12 including means for coupling the latch to the housing in a position wherein the latch is cooperable with the hook.

15. A device as claimed in claim 12 wherein the means for limiting the movement in the removed position permits the latch to normally remain retracted from the hook under gravity action.

16. A door latching device for operation with two foundation elements which are movable relative to each other to cooperate between an adjacent position relative to each other and a separated position relative to each other comprising:

a. a housing for mounting on one of the elements, b. latch engaging means for mounting on the other element, c. a latch pivotally mounted on the housing about a pivot location between a first position removed from engagement with the latch engagement means and a second position permitting engagement with the latch engaging means; and d. means for variably controlling the movement of the latch when in the removed position such that the extent of the removed position is selectable, and the first position removed from engagement with the latch engagement means is different for different positions of the means for controlling movement the movement controlling means including a member snugly fitted into said housing for being frictionally positioned in said housing and for variably contacting said latch.

17. A device as claimed in claim 16 wherein the means for limiting the movement of the removed position permits the latch to normally remain retracted from the latch engaging means under gravity action.

18. A device as claimed in claim 17 wherein a degree of moveability of the latch in the retracted positions determines the sensitivity of the latch to acceleration movement affecting the latch.

19. A device as claimed in claim 1 wherein the means for limiting the movement in the removed position permits the latch to normally remain retracted from the engaging means under gravity action.

20. A device as claimed in claim 16 wherein the means for limiting the movement in the removed position permits the latch to normally remain retracted from the latch engaging means under gravity action.

21. A door latching device comprising:

(a) a housing, (b) a movable latch pivotally mounted with said housing about a pivot location, (c) means for limiting latch motion over a range, the means being adjustable to multiple different positions over the range such that the amount of permissible latch movement is variable to be a selected amount in the range, such that there is a different amount of travel possible by the latch between a first position of non-engagement and a position of engagement with an engaging element, (d) the engaging element including a hook for engaging said latch and means for affixing said hook to a surface, the hook having elastic means for permitting manual deflection of the hook away from said latch, and (e) magnetic means coupling said latch at a position wherein the latch movement is limited by the coupling means, the first position being different for different positions of the means for limiting and wherein the means for limiting the latch in the first position engages the latch to normally remain retracted from the engaging means under the principle of unstable equilibrium wherein the center of gravity of the latch in an unlatched position is located in a position relatively closely vertically aligned with the pivot location.

22. A device as claimed in claim 21 wherein the means for limiting the movement in the removed position permits the latch to normally remain retracted from the engaging means under gravity action.

23. A door latching device operable under selectively different conditions comprising:

(a) a housing, (b) a movable latch pivotally mounted with said housing about a pivot location, (c) means for variably limiting latch motion over a range, the means being adjustable to multiple different positions over the range such that the amount of permissible latch movement is variable to be a selected amount in the range, such that there is a different amount of travel possible by the latch between a first position of non-engagement and a position of engagement with an engaging element, (d) the engaging element including a hook for engaging said latch and means for affixing said hook to a surface, the hook having elastic means for permitting manual deflection of the hook away from said latch, and (e) a coupling element operable with said latch for selectively limiting the latch movement, the arrangement being such that the operable conditions are: firstly, with the coupling element engaging the latch wherein the means for variably limiting latch movement is inoperable, secondly, with the coupling element disengaged from the latch such that the variable limiting means controls the sensitivity of the latch according to the position of the latch motion limiting means, and thirdly, the coupling element is engaged with the latch and the variable latch limiting means in a position further locking the movable latch with the coupling element, and wherein the means for limiting the latch in the removed position engages the latch to normally remain retracted from the engaging means under the principle of unstable equilibrium wherein the center of gravity of the latch in an unlatched position is located in a position relatively closely vertically aligned with the pivot location.

24. A door latching device comprising (a) a housing, (b) an engaging element, (c) a movable latch pivotally mounted with said housing about a pivot location, and (d) means for limiting latch motion over a range, the means being adjustable to multiple different positions over the range such that the amount of permissible latch movement is variable to be a selected amount in the range, such that there is a different amount of travel possible by the latch between a first position of non-engagement and a position of engagement with the engaging element, the first position of non-engagement being different for different positions of the limiting means and wherein the means for limiting the latch in the removed position engages the latch to normally remain retracted from the engaging element wherein the center of gravity of the latch in an unlatched position is located in a position relatively closely vertically aligned with the pivot location.

* * * * *

UNITED STATES PATENT AND TRADEMARK OFFICE
CERTIFICATE OF CORRECTION

PATENT NO. : 5,611,579

DATED : March 18, 1997

INVENTOR(S) : Arthur Kreitenberg

It is certified that error appears in the above-identified patent and that said Letters Patent is hereby corrected as shown below:

Column 2, line 39, "Of" should read --of--

Column 2, line 50, "6 and 7a" should read --6, 7 and 7B--

Signed and Sealed this

Twenty-eighth Day of October, 1997

*Attest:*

*Attesting Officer*

BRUCE LEHMAN

*Commissioner of Patents and Trademarks*